United States Patent [19]

Jander

[11] 3,930,339

[45] Jan. 6, 1976

[54] WINDOW REGULATOR, ESPECIALLY FOR AUTOMOBILES, WITH A THREADED CABLE MOVING IN A GUIDE

[75] Inventor: Horst Jander, Heusenstamm, Germany

[73] Assignee: Rockwell-Golde, GmbH, Frankfurt, Germany

[22] Filed: June 20, 1974

[21] Appl. No.: 481,395

[30] Foreign Application Priority Data

June 29, 1973 Germany ..... 7324139

[52] U.S. Cl. ..... 49/352; 49/374

[51] Int. Cl.[2] ..... E05F 11/48

[58] Field of Search ..... 49/352, 227, 374

[56] References Cited

UNITED STATES PATENTS 3,640,022 2/1972 Kurth et al ..... 49/352

FOREIGN PATENTS OR APPLICATIONS 201,909 10/1924 United Kingdom ..... 49/352

*Primary Examiner*—Kenneth Downey

[57] ABSTRACT

The invention relates to a window regulator, especially for automobiles, in which the window is connected to a drive by a cable which can move axially in a tubular guide, a portion of this guide being parallel to the window travel and an adjacent portion being shaped in an arc, whereby the path of a catch connected to the cable and serving for connection with the window is not restricted solely to the portion of the tubular guide extending parallel to the window travel but also extends at least partly into the region of the arc, and whereby the connection between the catch and the window comprises a slide-guide extending transversely to the window path.

4 Claims, 5 Drawing Figures

WINDOW REGULATOR, ESPECIALLY FOR AUTOMOBILES, WITH A THREADED CABLE MOVING IN A GUIDE

BACKGROUND OF THE INVENTION

Cable window regulators of this form are used where, in pursuance of the trend in modern automobile construction, the window height is relatively large compared to the height of the wall part of the bodywork or door casing which must receive the opened window. In such cases, a relatively large travel distance must be available to the window regulator in comparison with the height of the wall part or door casing.

Since however there is a lower limit to the bending radius of the threaded cable, the tubular guide must be constructed, at the end of that section of it which is parallel to the window path, as an arc. The catch travels into this arc at the end of its lifting stroke, thus leading to a constrained departure of the direction of travel of the catch from the direction of slide of the window.

In a known window regulator of the type described, this deviation of direction is compensated through a slide-guide extending transversely to the window path, by the engagement of a cylindrical component, for example a roller, secured to the catch and engaging in a slot-like guide mounted on the window. In principle, this form of embodiment has proved satisfactory, but in practice an undesirably large play develops at the slide-guide after a relatively short time, especially because of wear of the cylindrical part or roller, this play resulting in the annoying so-called backlash which occurs at the operating handle for the catch.

It is the objective of the invention to improve the slide-guide in a window regulator of the class initially described, so that it is relatively free of play even after considerable periods of use.

SUMMARY OF THE INVENTION

The stated problem is solved by this invention in that, a sliding block furnished with a cylindrical passage is provided in the slide-guide, into which passage a cylindrical bolt, non-rotatably secured to the catch engages. In accordance with the concept of this invention, the slide-guide is furnished with relatively large co-operating guide surfaces, whereby the sliding block is in surface contact with the slot-guide, whereas in the known forms of embodiment only a point contact or linear contact was provided at the guide elements. It can be seen that in accordance with this invention, a considerably more accurate drive-guide, with much reduced play, is made possible.

In pursuance of this novel concept, the diameter of the cylindrical passage and the correspondingly chosen diameter of the cylindrical bolt is only slightly smaller than the external dimension of the basically rectangular slide block. This ensures that relatively large guide surfaces resulting in low play, are obtained also for the rotational motion which occurs when the catch rotates relative to the slide block.

The arrangement may with advantage be such that the cylindrical passage extends right through the slide block, and that the cylindrical bolt possesses at its outer end in an annular shoulder which limits in one direction axial displacement between the slide block and the cylinder bolt. This form of embodiment enables the manufacturing and assembly tolerances between the window regulator and the pane guide, in a direction perpendicular to the pane, to be taken up. To take up such dimensional differences, the cylinder bolt can slide axially in the slide block in addition to its rotational motion.

It is of advantage, especially in regard to the form of embodiment just mentioned, if the slide block is provided on its sliding surfaces with grooves, into which the guiding edges of the slide-guide engage. In this manner, the slide block is provided with excellent lateral guidance and can therefore, move solely in the direction of the slide-guide.

The slide-guide may be mounted in known manner directly on the window. The invention is however not limited to this form of embodiment. The arrangement can also be such that the section of the tubular guide extending parallel to the window path is securely connected in known manner with a central guide bar parallel thereto and mounted in the window shaft, a slider, trolley or the like connected to the window being displaceable, also in known manner, upon this guide bar, and being engaged by the catch, and in that the slide guide is mounted in the slider, trolley or the like.

DESCRIPTION OF THE PREFERRED EMBODIMENTS

Figure 1:
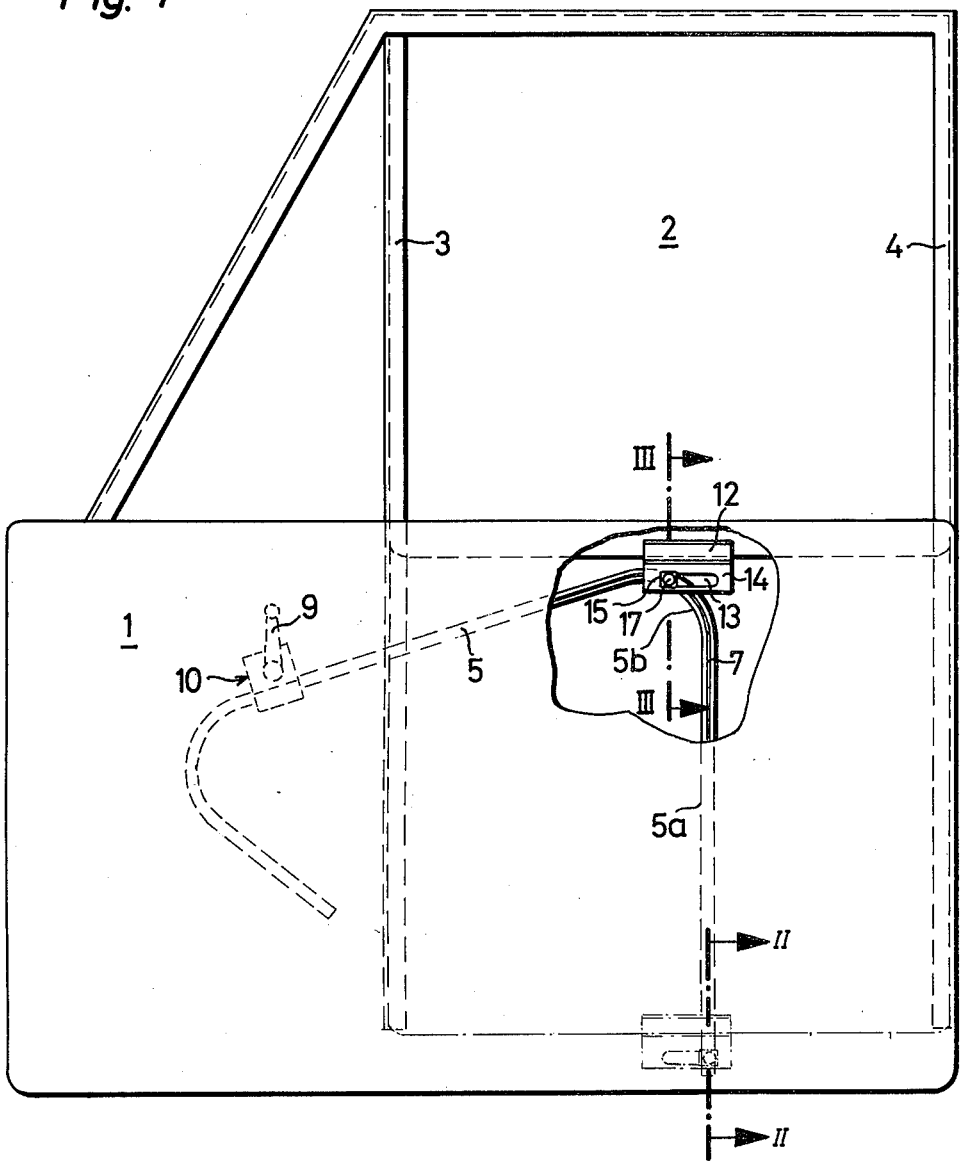
FIG. 1. A diagrammatic view of an automobile door, into which a window regulator constructed according to the invention is built, FIG. 2. A cut-away section along the line II—II of FIG. 1, FIG. 3. A cut-away section along the line III—III of FIG. 1, FIG. 4. A view, also cut away, of the slide guide and, FIG. 5. A diagrammatic view of an automobile door similar to that of FIG. 1, but with a window regulator equipped with a central guide bar.

FIG. 1 shows the automobile door in external elevational view cut away in that region which is essential for explaining the window regulator of the invention. Window frame strips 3 and 4, guiding the window 2, are fixed to the door 1. It can be seen that the height of the door 1 is only slightly greater than the height of window which determines the lifting travel of the window 2. The position of the lower edge of the window 2, when fully opened, is shown by a dot-and-dash line. The window regulator built into the door 1 consists in known manner, essentially of the stationarily mounted tubular guide 5, of the thrust-transmitting cable 6 (FIGS. 2, 3) moveable axially therein, of the catch 8 (FIGS. 2, 3) penetrating through the longitudinal slot 7 of the tubular guide 5, and of the drive housing 10 equipped with a hand-crank 9, in which housing there is mounted a drive pinion (not shown) rotationally keyed to the hand-crank 9 and engaging a helical thread 11 (FIG. 2) on the cable 6. Rotation of the hand-crank 9 and thus of the drive pinion lead to axial displacement of the cable 6 in the tubular guide 5.

To transmit the displacement motion of the cable 6 to the window 2, a lifting bar 12 is secured to the lower edge of the window pane, an angle iron strip or bracket 14 comprising the slide-guide 13 being secured to this window bar. The slide block 15 is inserted into the slide-guide 13, as can best be seen from FIGS. 2 to 4.

The cylinder bolt 17, secured to the catch 8 engages in the cylindrical passage 16 of the sliding block 15 in a rotationally free manner with little play. The catch 8, constructed in known manner in the form of a metal strip, having inclined recesses for the passage of the thread 11, and wrapped as a sleeve around cable 6 is cut back to form shoulders (12, FIG. 2) at the pressed-together lugs 18 which extend through the longitudinal slot 7 of the tubular guide 5. The cylinder bolt 17 is equipped with a slit-shaped hole 20 FIG. 3) passing through it, which received these lugs 18. To secure the cylinder bolt 17 to the catch 8, the cylinder bolt 17 is pushed with its slit-shaped hole 20 onto the lugs 18 until it abuts against the shoulders 19. Then, the lugs 18 are bent outwards and apart in an external widened portion 21 of the slit-shaped hole 20, in the manner shown in FIG. 3.

The cylinder bolt 17 carries, at its outer end, the annular shoulder 22, which limits axial displacements between the slide block 15 and the cylinder bolt 17 in one direction.

Figure 3:
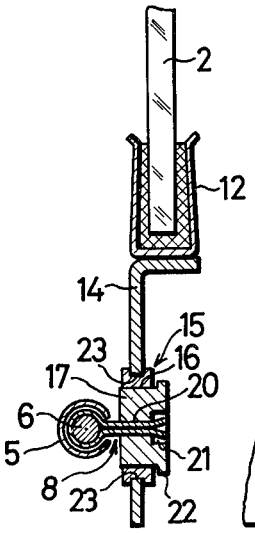
Figure 4:
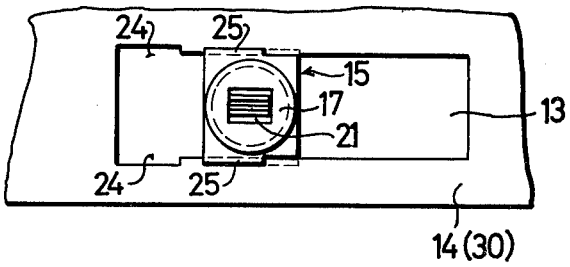
Figure 2:
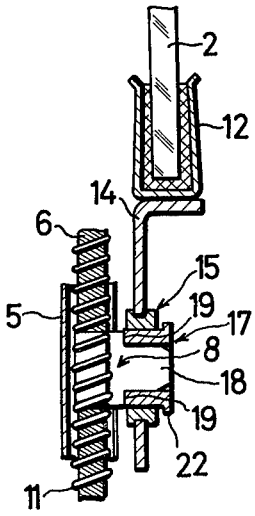

The grooves 23 of the slide block 15, into which the guiding edges of the slide-guide 13 engage, can best be seen from FIGS. 2 and 3. In order to enable the slide block 15 to be inserted into the slide-guide 13, this slide-guide 13 is equipped at one end with opposite widened cut-outs 24, while the slide block 15 possesses, on one side, shortened groove lateral walls 25, which can pass through the widened-out cut-outs 24.

As can be seen from FIG. 1, the tubular guide 5 extends with its section 5a parallel to the window path. The arc 5b adjoins at the top the straight line section 5a. As FIG. 1 shows, the catch 8, when the window 2 is closed, has run into the arc portion 5b. The necessary transverse motion for this purpose is made possible by the slide-guide 13 in conjunction with the slide block 15. At the commencement of the window closure travel, the slide block 15 is situated at the right-hand end of the slide-guide 13, The slide block retains this position until the catch 8 enters the arc *5b*. Not until it reaches the arc *5b*, and further drive is applied, does the slide block 15 move, in the slide-guide 13, towards the left until finally it adopts the position shown in full lines in FIG. 1.

Figure 5:
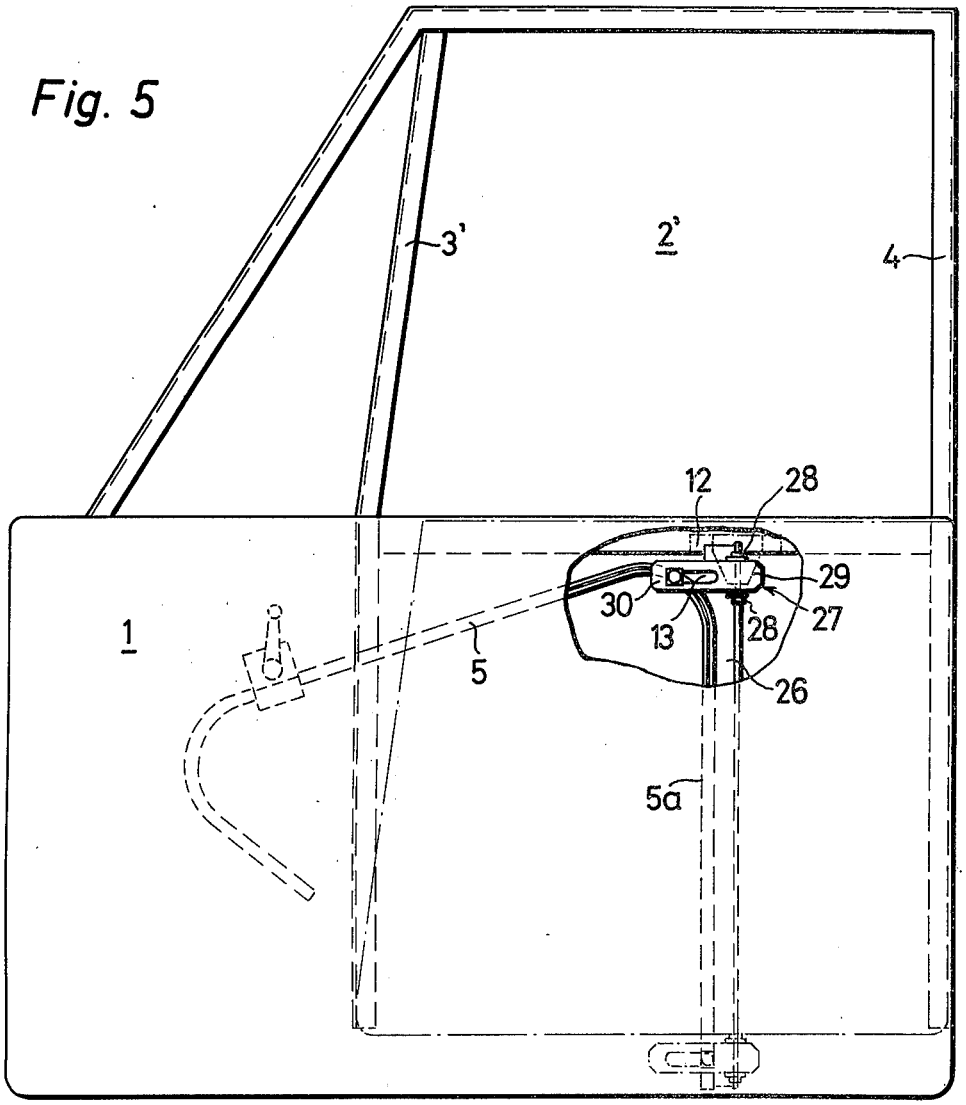

In the example of embodiment illustrated in FIG. 5, a central guide bar 26, itself of known type, is secured in the window shaft of the door 1, extending parallel to the section *5a* of the tubular guide 5; this guide bar serves for the parallel guidance of the window 2', which is guided over the entire window travel only in its rearward window frame strip 4, whereas the front edge of the window 2' moves out of the frame strip 3' after a small downward travel on the opening stroke. The slider 27 is slidably guided by means of slide blocks 28 on the central guide bar 26. The connection of the slider 27 to the window 2' is effected by a lifting batten 29, secured on the one hand to the slider 27 and on the other hand to the lifting bar 12. The lifting batten 29 and the lifting bar 12 are indicated only in dot-and-dash line, for reasons of clarity.

In this example of embodiment, the slide-guide 13', is situated in an extension 30 of the slider 27. In other respects, the form of embodiment of the window regulator according to the invention as illustrated in FIG. 5, corresponds to the form of embodiment described with reference to FIGS. 1 to 4.

What is claimed is:

1. In a window regulator, especially for automobiles, in which the window is connected to a drive by a cable capable of moving axially in a tubular guide, a portion of which guide extends parallel to the window path and in an arc adjoining thereto, whereby the path of a catch secured to the cable and serving for connecting to the window is not restricted to the section of the tubular guide which is oriented parallel to the window path, but extends at least partially over the region of the arc, and wherein the connection between the catch and the window comprises a bracket having a slide-guide extending transversely to the window path, the improvement including a slide-block slidably and non-rotatably disposed in the slide-guide, a cylindrical passage through the slide-block, a cylindrical bolt disposed in the passage, the bolt being fixedly and non-rotationally secured to the catch, and the bolt having an annular shoulder for limiting axial displacement between the slide-block and bolt.

2. A window regulator according to claim 1, wherein the slide-block is substantially rectangular, and the diameter of the cylindrical passage and the correspondingly selected diameter of the cylindrical bolt are only slightly smaller than the external dimension of the slide-block.

3. A window regulator according to claim 1, wherein the slide-block has grooved sliding surfaces, and the slide quide is defined by guiding edges which slidably engage the grooved sliding surfaces.

4. A window regulator according to claim 1, wherein the portion of the tubular guide extending parallel to the window path is securely connected to a central guide bar extending parallel thereto and mounted in the window shaft, a slider element being adapted to slide on the guide bar, the slider element being connected to the window, the catch being in engagement with the slider element, and the slide-guide being mounted in the slider element.

* * * * *